US011035119B2

(12) United States Patent
Sørensen et al.

(10) Patent No.: US 11,035,119 B2
(45) Date of Patent: Jun. 15, 2021

(54) PARTITION WALL

(71) Applicant: Rockwool International A/S, Hedehusene (DK)

(72) Inventors: Jannie Bakkaer Sørensen, København N (DK); Klavs Koefoed Jakobsen, Roskilde (DK)

(73) Assignee: ROCKWOOL INTERNATIONAL A/S, Hedehusene (DK)

( * ) Notice: Subject to any disclaimer, the term of this patent is extended or adjusted under 35 U.S.C. 154(b) by 0 days.

(21) Appl. No.: 16/495,213

(22) PCT Filed: Mar. 20, 2018

(86) PCT No.: PCT/EP2018/056952
§ 371 (c)(1),
(2) Date: Sep. 18, 2019

(87) PCT Pub. No.: WO2018/177799
PCT Pub. Date: Oct. 4, 2018

(65) Prior Publication Data

US 2021/0040736 A1 Feb. 11, 2021

(30) Foreign Application Priority Data

Mar. 27, 2017 (EP) ..... 17163028

(51) Int. Cl.
*E04B 2/74* (2006.01)

(52) U.S. Cl.
CPC ..... *E04B 2/7412* (2013.01); *E04B 2/7457* (2013.01)

(58) Field of Classification Search
CPC ..... E04B 2/7412; E04B 2/7457
See application file for complete search history.

(56) References Cited

U.S. PATENT DOCUMENTS

| | | | | |
|---|---|---|---|---|
| 9,587,399 | B2 * | 3/2017 | Jakobsen | E04C 2/243 |
| 9,909,305 | B2 * | 3/2018 | Lee | E04C 3/02 |
| 10,132,097 | B2 * | 11/2018 | Herfurth | E04H 9/16 |
| 10,851,543 | B2 * | 12/2020 | Grisolia | E04B 2/38 |
| 2009/0107064 | A1 | 4/2009 | Bowman | |
| 2016/0115690 | A1 * | 4/2016 | Jakobsen | E04B 1/18 52/404.4 |
| 2016/0258176 | A1 * | 9/2016 | Herfurth | E04C 2/26 |
| 2016/0376787 | A1 * | 12/2016 | Grisolia | E04B 1/26 52/236.3 |
| 2017/0362823 | A1 * | 12/2017 | Lee | E04B 1/942 |
| 2020/0123766 | A1 * | 4/2020 | De Graaf | E04B 2/7409 |
| 2020/0199869 | A1 * | 6/2020 | Simonic | E04B 2/7411 |

FOREIGN PATENT DOCUMENTS

| | | | |
|---|---|---|---|
| EP | 1081302 | A2 | 3/2001 |
| WO | 2014/187726 | A1 | 11/2014 |

* cited by examiner

*Primary Examiner* — Rodney Mintz
(74) *Attorney, Agent, or Firm* — Dinsmore & Shohl LLP

(57) ABSTRACT

A partition wall for a building structure having a plurality of building units separated by such partition wall to provide acoustic insulation therebetween. The partition wall has a plurality of column assemblies, such as at least two, substantially vertically mounted in a generally horizontally oriented base profile.

22 Claims, 4 Drawing Sheets

PARTITION WALL

REFERENCE TO RELATED APPLICATIONS

This application is a U.S. national stage application of PCT/EP2018/056952, filed Mar. 20, 2018, which claims priority from European Patent Application No. EP 17163028.8, filed Mar. 27, 2017. The entire content of each application is incorporated herein by reference.

FIELD OF THE INVENTION

The present disclosure relates to a partition wall, more particular to a party wall for a building.

BACKGROUND OF THE INVENTION

A party wall (also called parti-wall, parting wall or also known as a common wall) is a dividing partition between two adjoining building units that is shared by the residents on each side of the wall. Such a partition wall is often required to be load-bearing and the partition wall is also required to fulfil certain building requirements. Although these may vary from country to country, very often the wall must be designed to meet established criteria for sound, in particular airborne sound, and/or fire protection between the residential units. Thus, it is required that the partition wall according to the disclosure provides outstanding airborne sound and fire insulation.

Besides the requirements in relation to sound and fire insulation, it is further desirable that a partition wall has as small a thickness as possible since the area of space in the two adjacent building units is reduced due to the space that the partition wall takes up. These requirements can be somewhat counteracting when designing and constructing the partition wall.

It is known to build the partition wall as two halves, where two base profiles are installed and two sets of vertical metal profiles are mounted thereon and with insulation material therebetween, such as shown schematically in FIG. 1. However, this incurs extra building costs and space as two separate wall members need to be erected and insulated.

From WO 2014/187726 a thermally insulating outer wall of a building structure is known. However, such wall is specifically designed for excellent thermal insulation and different claddings on the interior and exterior sides. In order to achieve the acoustic (sound) insulation, the thickness is unacceptable large for a party wall.

It is on this background an object of the present disclosure to provide a partition wall between two building units, which satisfies the building requirements concerning sound and fire insulation for a party wall, but also has as relatively small thickness though being load-bearing and which is cost effective in materials and labour costs when erecting the wall.

SUMMARY OF THE INVENTION

This object is achieved by a partition wall for a building structure comprising a plurality of building units separated by such partition wall to provide excellent acoustic insulation therebetween, said partition wall comprising:

a plurality of column assemblies, such as at least two, substantially vertically mounted in a generally horizontally oriented base profile, each column assembly comprising a central element made of mineral wool fibres and at least a first spacer elements made of mineral wool fibres and extending from said central section towards the first side with a first intermediate profile provided between the central element and the first spacer elements and a second intermediate profile provided on the side of the central element facing the second side of the wall, a second spacer elements made of mineral wool fibres and extending towards the second side of the partition wall; and wherein the density of the mineral wool in the central element is higher than the density of the first and second spacer elements, one or more insulation sections fitted between two adjacent column assemblies, wherein each insulation section comprises an inner mineral wool fibre panel provided in a close fit between the central elements of said adjacent column assemblies;

first and second mineral wool fibre panels provided in a close fit between the first and second spacer elements, respectively, of said adjacent column assemblies, and wherein the densities of said first and second mineral wool fibre panels are substantially the same or lower than the density of the inner mineral wool panel; and a first external wall cover abutting the first mineral wool fibre panel and secured to the first spacer elements of the adjacent column assemblies, and a second external wall cover abutting the second mineral wool fibre panel and secured to the second spacer elements of the adjacent column assemblies.

By a partition wall according to the disclosure, there is provided a load-bearing and stabilizing wall system with limited acoustic (or sound) bridges being present. Mineral wool, fibre boards are well-known for their thermal and acoustic insulating and fire retarding properties so by providing the columns assemblies of mineral wool fibres, basically all the components of the wall contribute to achieving the advantageous sound insulation. From a cost perspective it is advantageous that only a single row of the column assemblies is provided whilst simultaneously also ensuring a low build-in space, i.e. an adequately low thickness. It is further advantageous that by the partition wall a sound reduction Rw of at least 55 dB can be achieved with a total partition wall thickness of 260 mm (10.24 inches) or less.

The airborne sound insulation designates the sound pressure reduction when sound is transmitted between two rooms through a building part, e.g. a wall, a door or a deck, and is described by the reduction index, R, with the unit decibel, dB. High values of R mean better airborne sound reduction.

Application rules, Measurements and Requirements for test facilities and equipment regarding sound insulation of building elements are specified according to building standards, such as the EN ISO 10140 series with the general title 'Acoustics Laboratory measurement of sound insulation of building elements'. To evaluate the airborne sound insulation of a test specimen, the weighted sound reduction index, Rw, is used. The value is determined according to e.g. the European standard EN ISO 717, part 1.

The weighted airborne sound insulation measured in a laboratory is designated Rw, whereas the weighted airborne sound insulation measured in a building is designated R'w. For building parts that are only measured in a laboratory 4-6 dB is subtracted from the result in order to compensate for any flanking transmission that can be expected when built on site.

Performance requirements for party walls in many countries are typically specified in the Building Regulations prescribing a minimum airborne sound insulation, R'w.

Furthermore, the party wall has a fire reduction class of REI 60; meaning that it can uphold its load bearing capacity and withstand a fire in an adjacent room for 60 minutes. This is measured according to DS/EN 1363-1:2012 Fire resistance tests General requirements in conjunction with EN 1365-1: 2012 Fire resistance tests for loadbearing elements Part 1: Walls.

In some embodiments of a partition wall according to the disclosure, the first external wall cover may be secured by penetrating fasteners, such as nails or screws, penetrating through the first mounting elements and into the first spacer elements. Said first spacer elements might correspondingly be secured to the first intermediate profile and anchored in the central element of the column assembly. Similarly the second external wall cover may also be secured by penetrating fasteners, such as nails or screws, penetrating through the second mounting elements and into the second spacer elements. Accordingly the second spacer elements might be secured to either a second intermediate profile and being anchored in the central element of the column assembly, or a building board which beforehand has been secured to adjacent second intermediate profiles. The screws or nails or similar fasteners are typically made of steel or other metal alloys.

In a further advantageous embodiment the at least second spacer elements are moved in the plane of the second mineral wool fibre panels and mounted on the building board, e.g. an OSB board, at a location between two column assemblies and thus displaced from said columns.

The main fiber orientation of such second spacer element might be chosen to run substantially parallel to the plane of the wall and thereby providing a superior spring effect. The displaced spacer along with the said fiber orientation is further disrupting acoustical bridging.

According to a further preferred embodiment, at least the length of the first spacer elements and the thickness of the first mineral wool fibre panel is substantially the same. Hereby a compact sound insulating layer towards one of the building units is provided.

In yet another preferred embodiment, however, the length of the second spacer elements is larger than the thickness of the second mineral wool fibre panel whereby a space is provided between the inner mineral wool fibre panel and the second mineral wool fibre panel. Hereby, it is possible to provide a building board, such as an oriented strand board (OSB) or a flake board, in the space between the inner mineral wool fibre panel and the second mineral wool fibre panel and wherein said board is secured to two adjacently situated second intermediate profiles. This board can provide a further bracing and airtightness to the partition wall.

Preferably, the thicknesses of the first and second mineral wool fibre panels are substantially the same. This provides for a substantially symmetrical wall which is advantageous while easing erecting the wall and the sound insulation properties thereby can be expected to be similar in both sides.

The first and second external wall covers are preferably each made of at least one layer of gypsum board, said first and second external wall covers may have the same or a different number of layers. Hereby the symmetry can be established if an OSB board is provided and/or the wall covers in each of the building units can be provided according to the needs of each of the building units, such as the load of any wall hung items in the units.

Preferably, the central element of the column assembly is made of mineral wool fibres having a density of 300-600 kg/m$^3$ (18.73-37.46 lb/ft$^3$), preferably approx. 500 kg/m$^3$ (31.21 lb/ft$^3$). Hereby a rigid central element is provided for achieving excellent load-bearing properties of the partition wall.

Preferably, the first and second spacer elements are made of mineral wool fibres having a density of 70-150 kg/m$^3$ (4.37-9.36 lb/ft$^3$). Typically first and second spacer elements would comprise substantially the same density of approx. 100 kg/m$^3$ (6.24 lb/ft$^3$).

In an advantageous embodiment of the disclosure, the first spacer element has a first density which is different from a second density of the second element, such as a first density of approx. 100 kg/m$^3$ (6.24 lb/ft$^3$) and a second density of approx. 150 kg/m$^3$ (9.36 lb/ft$^3$). Hereby, the spring properties of the insulating spacer elements in the columns can be adjusted in order to achieve an optimised sound insulation; in particular in the lower density range.

Preferably, the inner mineral wool fibre panel has a density of 60-80 kg/m$^3$ (3.75-4.99 lb/ft$^3$), more preferably 70 kg/m$^3$ (4.37 lb/ft$^3$), and the first and second mineral wool fibre panels have a density in the range of 35-50 kg/m$^3$ (2.18-3.12 lb/ft$^3$), More preferably, the first and second mineral wool fibre panels have substantially the same density, and more preferably a density of approx. 45 kg/m$^3$ (2.81 lb/ft$^3$). By these density ranges a good sound insulation and fire properties are achieved and due to the relative low weight the partition wall according to these embodiments are easy to install. The main fibre orientation of the aforesaid mineral wool fibre panels is substantially parallel with the plane of the wall, i.e. a preferably laminar fibre orientation which has superior thermal properties.

In an embodiment, typically the at least one of the first and second spacer elements in the column assembly have a fibre orientation substantially parallel with the main fibre orientation of the first and second mineral wool panels. Hereby the spring properties can be adjusted according to actual requirements of the partition wall in order to further adjust the sound insulation properties thereof.

In yet another embodiment, the fibre orientation of the spacer elements in general might differ in that their main orientation is substantially perpendicular, e.g. lamellae-like, to that one of the first and second mineral wool panels.

As is apparent from the aforesaid the partition or party wall according to the present disclosure substantially comprises mineral wool fibre components with excellent sound, fire and load-bearing properties.

BRIEF DESCRIPTION OF THE DRAWINGS

The disclosure is described in more detail in the following with reference to the accompanying drawings, in which.

DETAILED DESCRIPTION OF THE INVENTION

Figure 1:
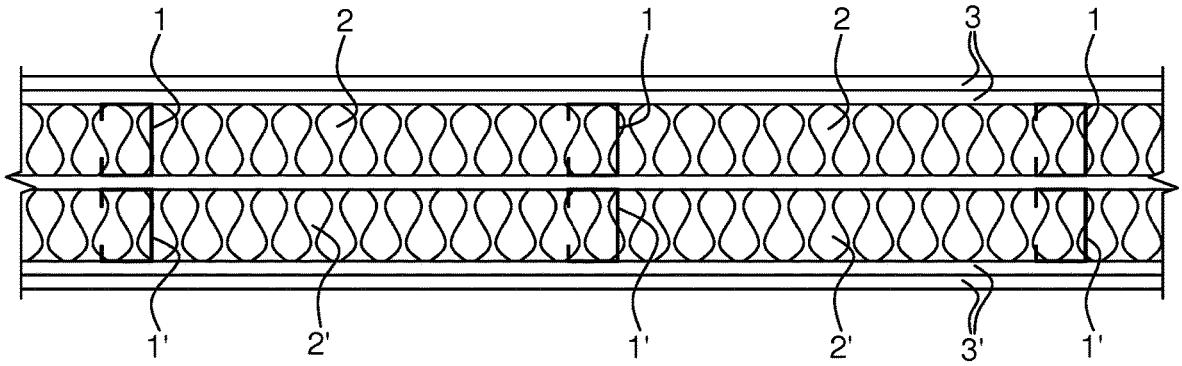
FIG. 1 PRIOR ART
FIG. 1 is a schematic cross-sectional view of a partition wall according to prior art.

With reference to FIG. 1, it is known to construct a partition wall where two parallel rows of column profiles 1, 1' are provided. The profiles 1, 1' are metal sheet profiles mounted in two horizontal floor base profiles (not shown). Between the profiles 1, 1', insulation slabs 2, 2' are provided to form two separate "half walls". On each side wall cover boards 3, 3' are fastened to the sheet profiles 1, 1'. However, this incurs extra building time and costs as two base profiles must be installed and as the metal sheet profiles 1, 1' extend across each of the "half walls", and if not mounted accurately this may also result in spot where sound may travel through the partition wall.

Contrary to this prior art solution of FIG. 1, the present disclosure as exemplified in the two embodiments shown in FIGS. 2 to 6, provides a partition wall, more particular a party wall for a building structure comprising a plurality of building units separated by such partition wall to provide acoustic insulation and fire protection therebetween.

Figure 2:
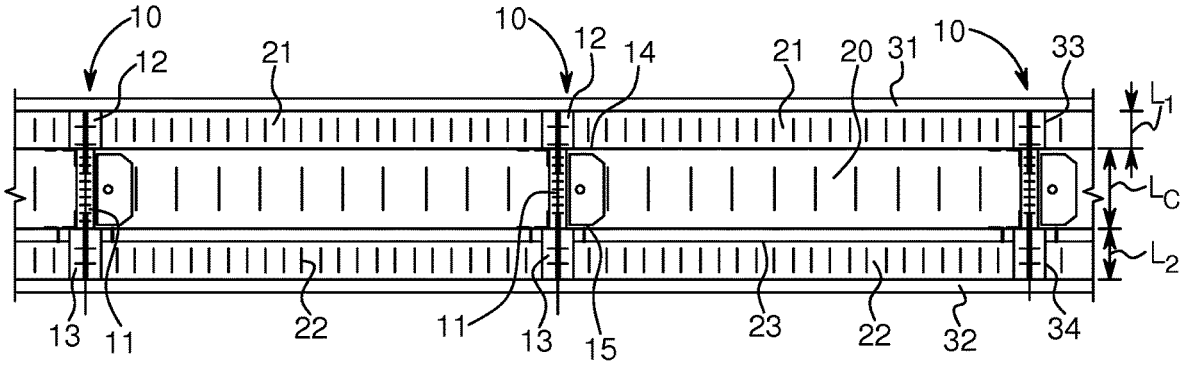
FIG. 2 is a schematic cross-sectional view of a partition wall according to a first embodiment of the disclosure.

With reference to FIG. 2 the said partition wall comprising a number of column assemblies 10 that are substantially vertically mounted in a generally horizontally oriented base profile (not shown). With reference also to the embodiment in FIGS. 3 and 4, each of the column assemblies 10 comprises a central element 11 made of mineral wool fibres and a first spacer element 12 and a second spacer element 13. The first and second spacer elements 12, 13 are provided on each side of the central element 11. The first and second spacer elements 12, 13 are made of mineral wool fibres and extend from the central element 11 and where first and second intermediate profiles 14, 15 are provided between the central element 11 and the first and second spacer elements 12, 13, respectively. A column assembly 10 according to the before described embodiments would typically be prefabricated and columns being mounted in one piece.

Insulation sections 20, 21, 22 are fitted between the adjacent column assemblies 10. The insulation sections comprise inner mineral wool fibre panels 20 provided in a close fit between the central elements 11 of two adjacent column assemblies 10. First and second mineral wool fibre panels 21, 22 are provided in a close fit between the first and second spacer elements 12, 13, respectively, of the adjacent column assemblies 10.

An first external wall cover 31 abutting the first mineral wool fibre panels 21 and secured to the first mounting elements 33 of the adjacent column assemblies 10, and a second external wall cover 32 abutting the second mineral wool fibre panels 22 and secured to the second mounting elements 34 of the adjacent column assemblies 10.

Figure 3:
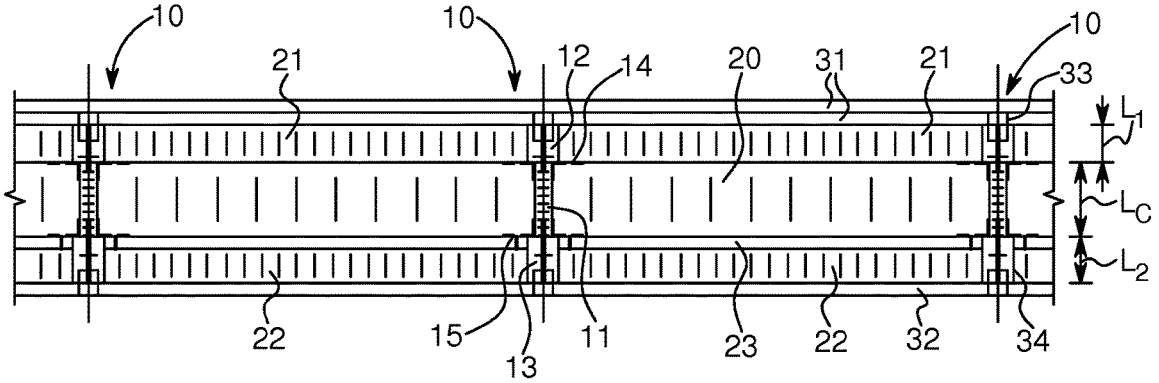
FIG. 3 is a schematic cross-sectional view of a partition wall according to a second embodiment of the disclosure.
Figure 4:
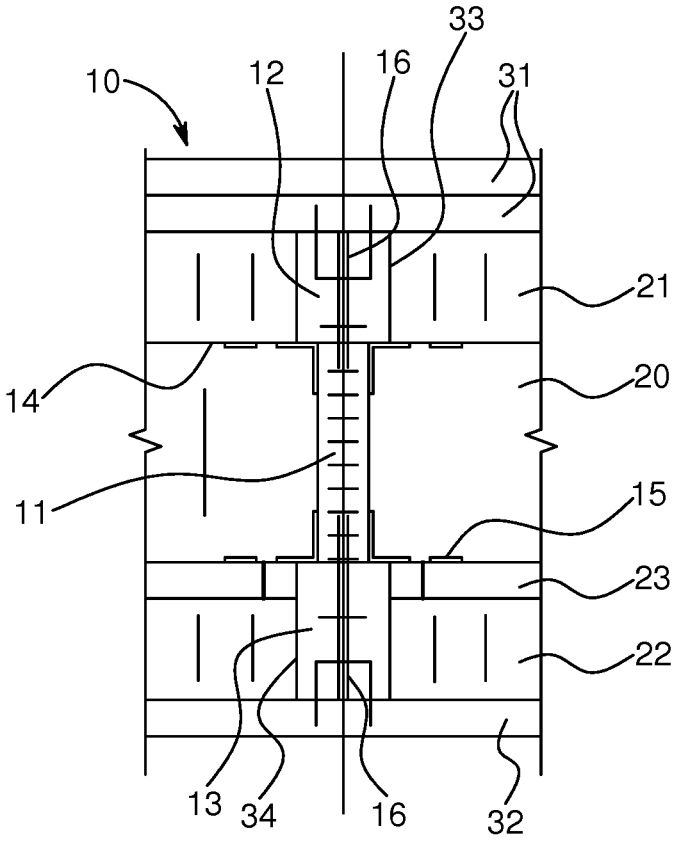
FIG. 4 is a detailed view of a column assembly according to the second embodiment.

In the column assemblies 10 in the partition wall according to the embodiments shown in FIGS. 2, 3 and 4, the density of the mineral wool in the central element 11 is higher than the density of the first and second spacer elements 12, 13. The densities of the first and second mineral wool fibre panels 21, 22 are substantially the same or lower than the density of the inner mineral wool panels 20.

By a partition wall according to the disclosure, very limited acoustic (or sound) bridges are present as the columns assemblies 10 are made of mineral wool fibres. Moreover, due to the relative high densities, the column assemblies 10 are stiff enough to provide stability and load-bearing properties to the wall construction.

The first external wall cover 31 is secured by penetrating fasteners 16, such as nails or screws, penetrating through each the first mounting elements 33 and into the first spacer elements 12. Said first spacer elements 12 correspondingly are secured to the first intermediate profile 14 and anchored in the central element 11 of the column assembly 10. Similarly the second external wall cover 32 is secured by penetrating fasteners 16, such as nails or screws, penetrating through the second mounting elements 34 and the second spacer elements 13. Accordingly the second spacer elements 13 will be secured to either a second intermediate profile 15 and being anchored in the central element 11 of the column assembly 10, or a building board 23 which beforehand has been secured to adjacent second intermediate profiles 15. The screws or nails or similar fasteners are typically made of steel or other metal alloys.

In the shown embodiments in FIGS. 2 and 3, the length $L_1$ of the first spacer elements 12 and the thickness of the first mineral wool fibre panel is substantially the same.

The length $L_2$ of the second spacer elements 13 is larger than the thickness of the second mineral wool fibre panel 22 so that a space is provided between the inner mineral wool fibre panels 20 and the second mineral wool fibre panels 22 between two adjacent column assemblies 10. In this space, a building board 23, such as an oriented strand board (OSB) or a flake board, is provided and the board 23 is secured to two adjacently situated second intermediate profiles 15.

In the shown embodiment the thicknesses of the first and second mineral wool fibre panels 21, 22 are substantially the same.

In the embodiment shown in FIG. 2 the first and second external wall covers 31, 32 are each made of one layer of gypsum board. In the embodiment shown in FIG. 3, the first external wall cover 31 is made up by two gypsum boards. In general, it is realised by the present disclosure that first and second external wall covers 31, 32 may have the same or a different number of layers and may differ in material.

In the embodiments shown in FIGS. 2 to 4, each of the column assemblies 10 comprise a central element 11 made of mineral wool fibres and also a first spacer element 12 and a second spacer element 13.

Figure 5:
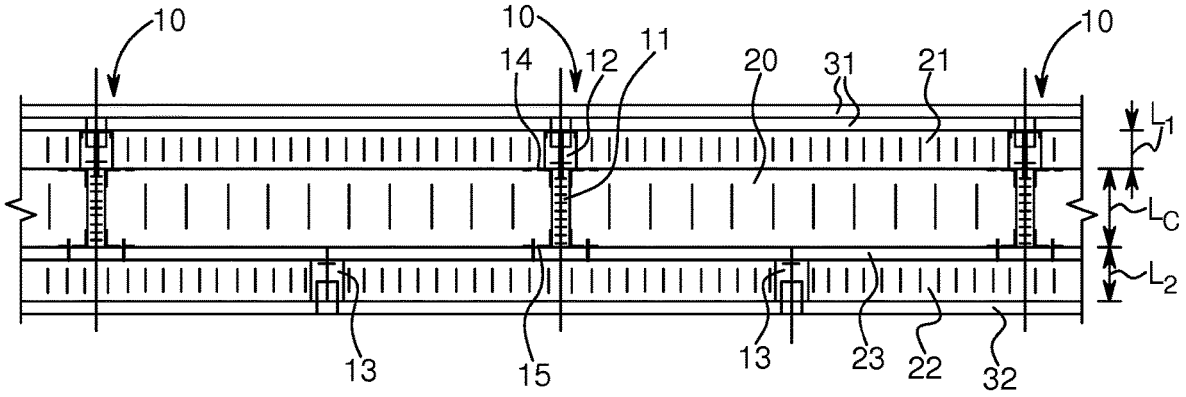
FIG. 5 is a schematic cross-sectional view of a partition wall according to a third embodiment of the disclosure.
Figure 6:
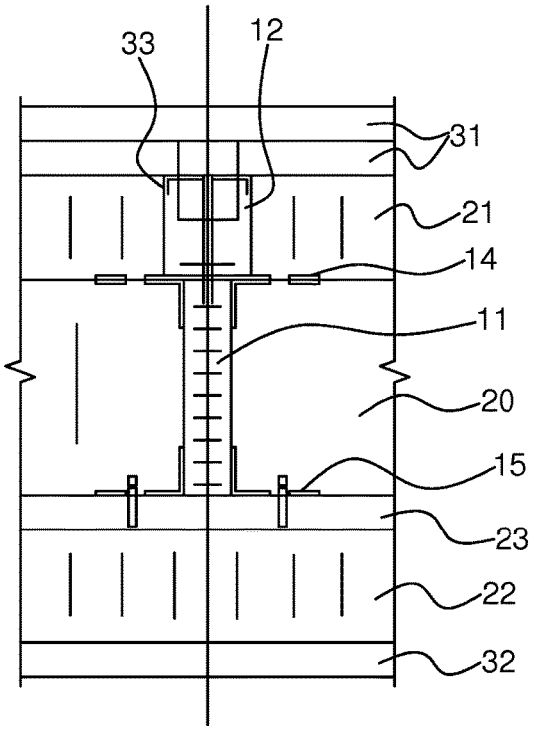
FIG. 6 is a detailed view of a column assembly according to this third embodiment.

However, as shown in the embodiment of FIGS. 5 and 6 it is found advantageous to displace the second spacer elements 13 so that the column assembly 10 comprises a central element 11 with a first and second intermediate profile 14, 15 on each side and a first spacer element 12 pointing towards the first side of the wall. Building boards 23 are provided in the space between the inner mineral wool panels 20 and the second mineral wool panels 22. The second spacer elements 13 are provided in a displaced configuration in a position different from the columns 10 as shown in FIG. 5. In the embodiment shown in FIG. 5 the second spacer elements 13 are secured to the building board 23 by a fastener, but could in an alternative embodiment be secured to the inner mineral wool panels, e.g. if no building board is provided.

In the embodiments of the figures, it is preferably that the central element 11 of the column assembly 10 is made of highly compacted mineral wool fibres having a density of 300-600 kg/m$^3$ (18.73-37.46 lb/ft$^3$), preferably approx. 500 kg/m$^3$ (31.21 lb/ft$^3$), and the first and second spacer elements 12, 13 are made of mineral wool fibres having a density of 70-150 kg/m$^3$ (4.37-9.36 lb/ft$^3$).

In an embodiment (not shown) the first spacer element 12 has a first density, such as a first density of approx. 100 kg/m$^3$ (6.24 lb/ft$^3$), which is different from the density of the second element 13 being approx. 150 kg/m$^3$ (9.36 lb/ft$^3$). Moreover, in order to provide a spring-mass dampening of the sound impacting the external wall covers 31, 32, at least one of the first and second spacer elements 12, 13 in the column assemblies 10 have a fibre orientation of the spacer elements different in that their main orientation, which is substantially perpendicular, e.g. lamellae-like, to that one of the first and second mineral wool panels 21, 22, such that e.g. the second spacer elements 13 are less compressible in the length direction.

In the currently preferred embodiments, the inner mineral wool fibre panels 20 have a density of 60-80 kg/m$^3$ (3.75-4.99 lb/ft$^3$), more preferably 70 kg/m$^3$ (4.37 lb/ft$^3$), and the first and second mineral wool fibre panels 21, 22 have a density in the range of 35-50 kg/m$^3$ (2.18-3.12 lb/ft$^3$) and more preferably the first and second mineral wool fibre panels 21, 22 have substantially the same density, and more preferably a density of approx. 45 kg/m$^3$ (2.81 lb/ft$^3$).

To test the sound reduction of a party wall according to two embodiments of the disclosure, test measurements were performed.

For the test, the partition walls in both embodiments comprise columns of 100 mm (3.94 inches) central elements mounted in U-profiles at the top and bottom.

One side of the central elements, the columns also consists of 50 mm (1.97 inches) first spacer elements that are screwed onto the central element with an intermediate profile in between. Onto these spacers wall cover of two layers of the Fermacell®-type, 15 mm (0.59 inches), were fastened by screws.

12 mm (0.47 inches) OSB plates are screwed on the second side of the columns via the second intermediate profiles. The OSB plates are butted together and openings between the plates are closed using tape. On the OSB plates approximately at the midway point between the columns a set of second spacer elements of 50 mm (1.97 inches) are screwed to the OSB plates. One layer of wall cover of the type Fermacell®, 15 mm (0.59 inches), is screwed onto these second spacer elements.

The cavities between the central portions of the columns are filled with 100 mm (3.94 inches) inner mineral wool fibre panels of 70 kg/m$^3$ (4.37 lb/ft$^3$), whereas the cavities between the first spacer elements and the cavities between the second spacer elements are filled with 50 mm first and second mineral wool fibre panels of 45 kg/m$^3$ (2.81 lb/ft$^3$).

The total thickness of the partition wall is approx. 260 mm (1.97 inches) and with a weight of approx. 71 kg/m$^2$ (4.43 lb/ft$^3$).

The wall was mounted between two reverberation rooms in a 1.15 m (45.28 inches) deep concrete frame with a width of 3.70 m (145.67 inches) and a height of 2.69 m (105.91 inches).

Laboratory measurement of sound reduction index was carried out according to the EN ISO 10140:2010 part 1, 2, 4 and 5. The test results were evaluated according to EN ISO 717-1:2013.

In a first measurement regarding sound insulation of building elements, i.e. a party wall according to the embodiments of FIG. 3, there was found a minimum airborne sound insulation Rw of 55 dB.

In a second measurement regarding sound insulation of building elements, i.e. a party wall according to the embodiment of FIG. 5, there was measured a minimum airborne sound insulation Rw of 60 dB.

Above the disclosure is described with reference to some preferred embodiment. However, by the disclosure it is realised that variants and equivalences to one or more of the features also fall within the scope of the disclosure as defined in the accompanying claims.

The invention claimed is:

1. A partition wall for a building structure comprising a plurality of building units separated by such partition wall to provide acoustic insulation therebetween, said partition wall having a first and a second side and comprising:

a plurality of column assemblies substantially vertically mounted in a horizontally oriented base profile, each column assembly comprising:

a central element composed of mineral wool fibres and at least a first spacer elements composed of mineral wool fibres and extending from said central element towards the first side with a first intermediate profile provided between the central element and the first spacer elements and a second intermediate profile provided on a side of the central element facing the second side of the wall, a second spacer elements composed of mineral wool fibres and extending towards the second side of the partition wall; and wherein a density of the mineral wool in the central element is higher than a density of the mineral wool in the first and second spacer elements, one or more insulation sections fitted between two adjacent column assemblies of the plurality of column assemblies, wherein each insulation section comprises:

an inner mineral wool fibre panel provided in a close fit between the central elements of said adjacent column assemblies;

first and second mineral wool fibre panels provided in a close fit between the first and second spacer elements, respectively, of said adjacent column assemblies, wherein densities of said first and second mineral wool fibre panels are substantially the same and wherein the densities of said first and second mineral wool fibre panels are lower than a density of the inner mineral wool panel; and a first external wall cover abutting the first mineral wool fibre panel and secured to the first spacer elements of the adjacent column assemblies, and a second external wall cover abutting the second mineral wool fibre panel and secured to the second spacer elements of the adjacent column assemblies;

wherein at least one of the first and second spacer elements in the column assembly has a fibre orientation which is substantially parallel with a main fibre orientation of the first and second mineral wool panels.

2. The partition wall according to claim 1, wherein the partition wall is a party wall.

3. The partition wall according to claim 1, wherein at least a length of the first spacer elements and a thickness of the first mineral wool fibre panel is substantially the same.

4. The partition wall according to claim 1, wherein a length of the second spacer elements is larger than a thickness of the second mineral wool fibre panel whereby a space is provided between the inner mineral wool fibre panel and the second mineral wool fibre panel.

5. The partition wall according to claim 1, wherein the first and second spacer elements are displaced relative to each other.

6. The partition wall according to claim 1, wherein the first and second spacer elements are both provided to extend from the central element of the column assembly.

7. The partition wall according to claim 1, wherein the first and second external wall covers are each made of at least one layer of gypsum board, and said first and second external wall covers have the same or a different number of layers.

8. The partition wall according to claim 1, wherein the central element of the column assembly is made of mineral wool fibres having a density of 300-600 kg/m$^3$ (18.73-37.46 lb/ft$^3$).

9. The partition wall according to claim 1, wherein the first and second external wall covers are each made of the same material.

10. The partition wall according to claim 1, wherein a measured sound reduction Rw of at least 55 dB or higher according to EN ISO 10140:2010 in combination with EN ISO 717-1:2013 is achieved.

11. The partition wall according to claim 1, wherein the fibre orientation of the at least one of the spacer elements in the column assembly and the main fibre orientation of the first and second mineral wool panels are parallel to the first and second sides of the partition wall.

12. The partition wall according to claim 11, wherein the fibre orientation of each of the spacer elements in the column assembly is parallel to the first and second sides of the partition wall.

13. The partition wall according to claim 1, wherein the first and second spacer elements are made of mineral wool fibres having a density of 70-150 kg/m$^3$ (4.37-9.36 lb/ft$^3$).

14. The partition wall according to claim 13, wherein the first spacer element has a first density which is different from a second density of the second element.

15. The partition wall according to claim 14, wherein the first density is approx. 100 kg/m$^3$ (6.24 lb/ft$^3$) and the second density is approx. 150 kg/m$^3$ (9.36 lb/ft$^3$).

16. The partition wall according to claim 1, wherein the inner mineral wool fibre panel has a density of 60-80 kg/m$^3$ (3.75-4.99 lb/ft$^3$), and the first and second mineral wool fibre panels have a density in the range of 35-50 kg/m$^3$ (2.18-3.12 lb/ft$^3$).

17. The partition wall according to claim 16, wherein the first and second mineral wool fibre panels have substantially the same density.

18. The partition wall according to claim 17, wherein the first and second mineral wool fibre panels have a density of approx. 45 kg/m$^3$ (2.81 lb/ft$^3$).

19. The partition wall according to claim 1, wherein the thicknesses of the first and second mineral wool fibre panels are substantially the same.

20. The partition wall according to claim 19, wherein a building board is provided in a space between the inner mineral wool fibre panel and the second mineral wool fibre panel and wherein said board is secured to two adjacently situated second intermediate profiles.

21. The partition wall according to claim 20, wherein the first spacer element is fitted to the central element in the column assembly and the second spacer element is secured to the building board.

22. The partition wall according to claim 20, wherein the building board is an oriented strand board (OSB) or a flake board.

* * * * *